United States Patent [19]

Hassall

[11] 4,120,784

[45] Oct. 17, 1978

[54] SCREENING APPARATUS

[75] Inventor: Anthony George Hassall, Sandiway, England

[73] Assignee: N. Greening Limited, Warrington, England

[21] Appl. No.: 773,036

[22] Filed: Feb. 28, 1977

[30] Foreign Application Priority Data

Jun. 16, 1976 [ZA] South Africa ..... 76/3584
Jun. 17, 1976 [AU] Australia ..... 14997

[51] Int. Cl.[2] ..... B07B 1/46
[52] U.S. Cl. ..... 209/399
[58] Field of Search ..... 209/392–399, 209/302, 308, 408, 274, 275, 403, 405; 210/498, 499, 163; 428/33; 264/DIG. 70; 52/673, 581, 474, 495

[56] References Cited

U.S. PATENT DOCUMENTS

| | | | |
|---|---|---|---|
| 2,914,177 | 11/1959 | Parks | 209/396 |
| 2,964,187 | 12/1960 | Riedel | 209/392 |
| 3,042,206 | 7/1962 | Olender | 209/395 |
| 3,664,503 | 5/1972 | Felden | 209/397 |
| 3,684,091 | 8/1972 | Wehner | 209/399 X |
| 3,833,120 | 9/1974 | Obata | 209/399 |
| 3,970,550 | 7/1976 | Fry et al. | 209/399 |
| 3,980,555 | 9/1976 | Freissle | 209/399 X |

FOREIGN PATENT DOCUMENTS

| | | | |
|---|---|---|---|
| 2,130,177 | 12/1971 | Fed. Rep. of Germany | 209/395 |

*Primary Examiner*—Frank W. Lutter
*Assistant Examiner*—Ralph J. Hill
*Attorney, Agent, or Firm*—William Anthony Drucker

[57] ABSTRACT

Screening apparatus, particularly vibratory screening apparatus, includes a screening surface formed of one or more plates of flexible non-metallic material having apertures therethrough, with a plurality of attachment bars projecting from the underface of the or each plate at intervals along the length thereof. Each attachment bar extends across the width of the plate, and the plate or plates are supported by a support structure which includes a plurality of spaced support bars provided at intervals along their length corresponding to the intervals of the attachment bars with apertures of a shape to receive the attachment bars of the plate or plates.

11 Claims, 6 Drawing Figures

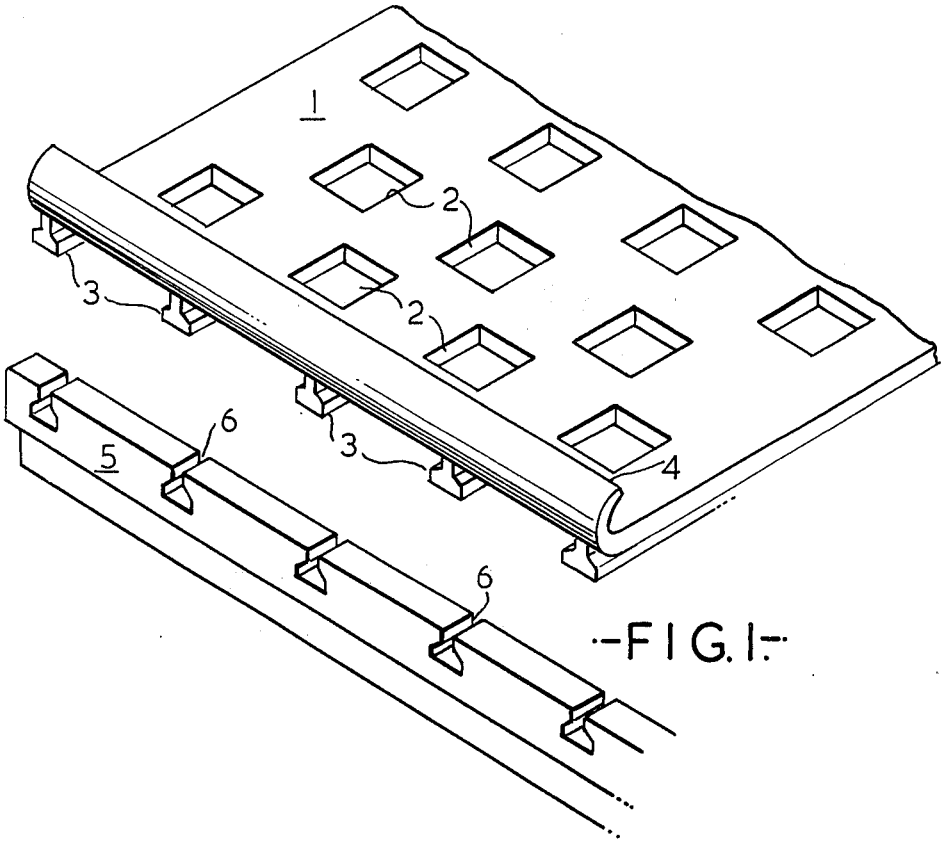
-FIG. 1-
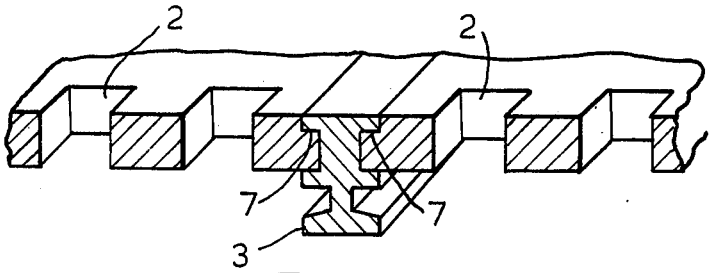
-FIG. 2-

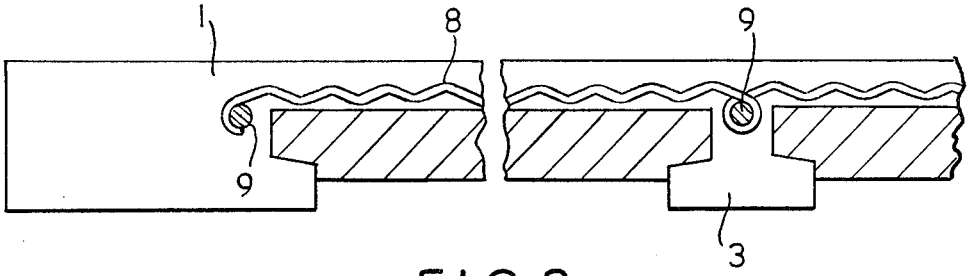
-FIG. 3-
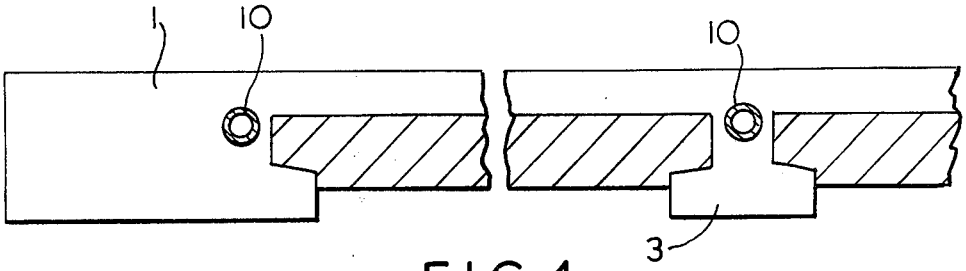
-FIG. 4-

SCREENING APPARATUS

The present invention relates to screening apparatus, particularly vibratory screening apparatus employing screens of flexible non-metallic material tensioned and supported from beneath to present a cambered screening surface or deck.

One of the problems encountered in the use of such screening apparatus is known as the "trampolining effect" which causes the screen to flap against its supports giving rise to unnecessary wear and damage and also to the risk of particles or lumps of the material being screened being propelled with considerable force off the screening deck.

It is an object of the present invention to overcome this problem and to this end the screening surface of the apparatus is made up of one or more apertured screen plates of flexible non-metallic material having projecting from the undersurface thereof at intervals along the length of the or each screen plate, a plurality of attachment bars extending in the direction of the width of the or each screen plate, and the support structure for the plate or plates comprises a plurality of spaced support bars running transversely of the attachment bars and provided at intervals along their length corresponding to the intervals of the attachment bars of the or each screen plate with slots of a shape to receive the attachment bars of the screen plate or plates. The cambering of the screen surface is achieved by reason of the support bars having different heights across the width of the screen so that when the screen is attached to the support bars it has the desired camber.

Preferably the screening surface is made up of an assembly of pre-formed modules the edges of which are shaped to fit together and/or to provide cavities into which a synthetic plastics material can be moulded to serve, when set, to lock the individual modules together to form a unitary screen.

The attachment bars may have a cross-sectional shape such as to simply rest in the slots in the support bars of the support structure or such as to interfit in locking manner in such slots.

Where the circumstances of use are such as to require additional strength in the screening surface reinforcement rods or wires may be moulded into the material of the screen plates parallel to the support bars.

The screening surface may be tensioned by means of tensioning wires or rods extending through the material of the screen plates parallel to and above the level of the attachment bars at least at opposite ends of such bars. Conveniently, where reinforcement rods or wires are also used the latter may serve to locate the tensioning wires between opposite ends during moulding of the screening plate or plates so that the tensioning wires extend wholly in the material of the plate or plates along their entire length.

Instead of the tensioning rods or wires and/or the reinforcing rods or wires being moulded directly into the material of the plate or plates they may pass through bores extending through the material of the plate. The bores are preferably provided by moulding thin walled tubes into the material of the plates, the rods or wires being inserted after formation of the screening surface.

The tensioning and/or reinforcing wires or rods may serve to hold individual plates or modules in assembled relation with others to form the screening surface.

The various features and advantages of the invention will be apparent from the following description of embodiments thereof taken in conjunction with the accompanying drawings of which:

FIG. 1 is an isometric view of part of a screen plate and support bar according to the invention prior to attachment of the one to the other, FIG. 2 is a section of portion of a screen plate illustrating an alternative way of providing the attachment bars, FIG. 3 is a section of a portion of a screen plate illustrating the use of crimped reinforcing wires serving to locate tensioning rods, and FIG. 4 is a section similar to that of FIG. 3 illustrating the use of a thin walled tube to form bores for the tensioning rods.

Figure 5:
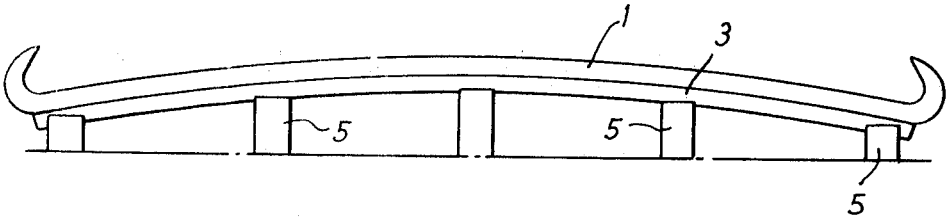
FIG. 5 is an edge elevation of a modification wherein support bars have different heights across the width of the screen to produce cambering of the screening surface.

Referring to FIG. 1, the screen plate 1 is a generally flat plate of a flexible synthetic plastics material having a pattern of sizing apertures 2 each extending through the thickness of the plate. Formed integrally, for example by moulding, with the plate 1 to project from its undersurface are a plurality of attachment bars 3 of T-shape in section spaced apart along the length of the plate and extending across the full width of the plate. The side edges of the plate 1 have a curved configuration as indicated at 4 to facilitate clamping of the plates in position in the screening apparatus and, if required, the tensioning of the plates. Each of a number of support bars 5, of which only one is shown in FIG. 1, has T-shaped slots 6 in its upper surface at intervals corresponding to the spacing of the bars 3 of the screen 1. The slotted parts of these bars may be a capping of resilient nonmetallic material secured to a more rigid base or the whole bar may be formed either of resilient or rigid material. Three or more bars such as 5 are spaced apart across the width of the deck, the bars having, or being mounted to have, different heights so that the slotted surfaces of all the bars define the desired camber to be formed by the screen when attached to the bars 5, as shown in FIG. 5.

The screen plate is located in position by threading the T-section bars 3 through the T-shaped slots in the successive supporting bars 5 across the width of the deck and clamping edges 4 by any conventional clamping arrangement which may, if desired be arranged to tension the screen plate.

The bars 3 and corresponding slots in bars 5 need not be of T-shape in section but may be of L-shape or have the bar of the T of circular form, all of which sections would provide a locking effect. Where a positive locking effect is not needed the bars and slots may be of simple rectangular form.

The bars 3 may be formed, as previously mentioned, integrally with the plate 1 by moulding the plate and bars in the same material. They may also be formed integrally with plate 1 but in a material having a different degree of resilience so as to stiffen or otherwise modify the overall physical characteristics of the screen plate.

Instead of the bars 3 being formed integrally with the plate 1 during the forming of such plate they may be added to a preformed plate having certain ones of its apertures 2 of stepped form by moulding the bars into such stepped apertures as indicated in FIG. 2. In this alternative form of plate the plate is first formed with the customary pattern of sizing apertures except that spaced ones of the apertures lying in each of a plurality of spaced lines across the width of the screen are formed with a step 7. The preformed plate is then laid across a mould or a plurality of moulds shaped to provide the T-section of the attachment bars with the mould cavities in register with the lines of stepped form apertures in the sheet. A suitable moulding liquid is then introduced to fill the mould cavities and the stepped apertures to form the T-section attachment bars securely attached to the plate.

This alternative way or providing the attachment bars is particularly useful when it is desired that the bars should have a different degree of resilient to that of the plate itself. It will be appreciated that under the same circumstances preformed bars could be incorporated as inserts in the moulding of the screen plate.

The screen plate 1 may be reinforced by incorporating metal rods or wires in the material of the plate above the bars 3 to extend parallel to the bars 5. The plate 1, or assembly of plates if more than one is used to form the screening surface, may be tensioned in any conventional manner but preferred ways of effecting such tensioning are illustrated in FIGS. 3 and 4. In FIG. 3 there is shown embedded in the material of the plate 1 a reinforcing wire 8 of wavy or crimped form which is formed into loops at intervals along its length. Several such wires are incorporated in the plate during moulding of the latter the wires being spaced apart across the width of the plate with the loops in the various wires in alignment. Tensioning rods or wires 9 extend across the width of the plate each through a series of aligned loops in the wire 8 and are terminated in conventional manner in filaments to facilitate the application of tension to the rods or wires 9. The loops may be omitted and the tensioning rods or wires located simply by the undulations in the crimped form of wire 8.

Instead of incorporating the tensioning rods or wires 9 in the material of the plate during moulding the arrangement illustrated in FIG. 4 may be employed. In the embodiment of FIG. 4 thin walled tubes 10 are incorporated in the material of the plate during moulding to form bores through which the tensioning rods or wires can afterwards be threaded. The same technique can be used for reinforcing rods or wires provided that the tubes for each form of wire are at different levels. This can conveniently be achieved by locating the tubes for the tensioning wires in the material of the attachment bars 3 and the tubes for the reinforcing rods in the material of the plate above the bars 3.

Figure 6:
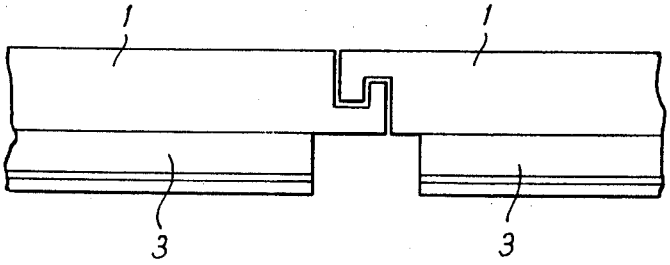
FIG. 6 is an edge elevation to show edges of two adjacent plate-like screening surface modules shaped to permit fitting together.

The provision of tubes 10 also facilitates the joining together of a series of plate modules to form a complete screen, such modules being threaded on to a pair or more of spaced apart tensioning wires in untensioned state to form a strip of modules extending across the width of the screen and a series of such strips arranged to form a complete screen. The edges of the modules are preferably of stepped or other interfitting configuration (see FIG. 6 which shows a simple example) to prevent or limit relative movement between adjacent modules. The shaping of the edges of the modules can conveniently be such as to form apertures between adjacent modules into which a suitable material such as that of the modules themselves can be cast to form the assembled array of modules into a unitary screen structure.

I claim:

1. Screening apparatus including a screening surface formed of one or more plates of flexible nonmetallic material having apertures therethrough, a plurality of attachment bars projecting from the underface of the or each plate at intervals along the length thereof, each attachment bar extending in the direction of the width of the plate, and a support structure for supporting said plate or plates, said support structure including a plurality of spaced support bars running transversely of the attachment bars and provided at intervals along their length corresponding to the intervals of the attachment bars with slots of a shape to receive the attachment bars of the plate or plates.

2. Screening apparatus according to claim 1 wherein the cross-sectional shape of the attachment bars and the shape of the slots in the support bars are such that the slots receive and retain the attachment bars.

3. Screening apparatus according to claim 1 wherein the support bars are arranged to have different heights across the width of the screen to produce a cambering of the screening surface.

4. Screening apparatus according to claim 1, wherein the screening surface is formed of an array of plate-like modules having apertures therethrough and edges shaped to fit together with the edges of adjacent modules in the array.

5. Screening apparatus according to claim 4 wherein the module edges have such a shape as to provide cavities between adjacent modules and the modules of the array are joined into a unitary whole by means of a synthetic plastics material moulded into such cavities.

6. Screening apparatus according to claim 1 wherein the screening surface has reinforcement wires or rods moulded into the material thereof at intervals across the width thereof, said reinforcement wires or rods extending parallel to said support bars.

7. Screening apparatus according to claim 6, wherein the screening surface further includes tensioning wires or rods moulded into the material thereof at intervals along the length thereof, said tensioning wires or rods extending parallel to said attachment bars and above the level of such bars at least at opposite ends of said tensioning wires or rods and said reinforcement wires or rods serve to locate said tensioning wires or rods.

8. Screening apparatus according to claim 1 wherein the screening surface includes tensioning wires or rods extending parallel to said attachment bars and above the level of such bars at least at opposite ends of said tensioning wires or rods.

9. Screening apparatus according to claim 1 including thin-walled tubes moulded into the material of the screening surface at intervals along the length thereof and extending parallel to said attachment bars to receive tensioning wires or rods.

10. Screening apparatus according to claim 9 wherein said tubes extend through said attachment bars.

11. Screening apparatus as claimed in claim 1, wherein at least some of the attachment bars extend completely across the width of the plate.

* * * * *